US006971862B2

(12) United States Patent
Shin

(10) Patent No.: US 6,971,862 B2
(45) Date of Patent: Dec. 6, 2005

(54) APPARTUS FOR PREVENTING OVERHEAT OF SCROLL COMPRESSOR

(75) Inventor: Dong-Koo Shin, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/751,980

(22) Filed: Jan. 7, 2004

(65) Prior Publication Data

US 2004/0228751 A1 Nov. 18, 2004

(30) Foreign Application Priority Data

May 12, 2003 (KR) ..... 10-2003-0029912

(51) Int. Cl.[7] ..... F04C 18/02; F03C 02/00

(52) U.S. Cl. ..... 418/55.1; 418/55.2; 418/270; 137/514.5; 137/533.31; 137/540

(58) Field of Search ..... 418/55.1, 270; 137/220, 513.3, 514.5, 514.7, 533.31, 540

(56) References Cited

U.S. PATENT DOCUMENTS 6,027,321 A * 2/2000 Shim et al. ..... 418/55.1
6,132,191 A * 10/2000 Hugenroth et al. ..... 418/55.1
6,224,356 B1 * 5/2001 Dewar et al. ..... 418/55.1
6,227,830 B1 * 5/2001 Fields et al. ..... 418/55.1
6,390,792 B1 * 5/2002 Tarng et al. ..... 418/55.1

FOREIGN PATENT DOCUMENTS

JP 91-15790 9/1991
JP 06026472 A * 2/1994 ..... F04C 18/02

* cited by examiner

*Primary Examiner*—Theresa Trieu
(74) *Attorney, Agent, or Firm*—Birch, Stewart, Kolasch & Birch, LLP

(57) ABSTRACT

An apparatus for preventing overheat of a scroll compressor comprising: an overload preventing device for connecting or cut off a power source by a temperature and a current; a valve housing formed as a predetermined shape and fixedly coupled to the fixed scroll; a volume type valve movably inserted into the valve housing for opening and closing the discharge hole of the fixed scroll; and a valve pressurizing means located in the valve housing for increasing an input current by pushing the volume type valve and thus by blocking the discharge hole when temperature of discharge gas discharged to the discharge hole of the fixed scroll is more than a predetermined temperature. Accordingly, when a temperature of discharge gas is drastically or gradually increased and thus becomes a preset high temperature by several conditions at the time of driving the compressor, a driving of the overheated state is stopped by an immediate reaction thus to prevent a component damage.

7 Claims, 6 Drawing Sheets

APPARTUS FOR PREVENTING OVERHEAT OF SCROLL COMPRESSOR

This Nonprovisional application claims priority under 35 U.S.C. § 119(a) on Patent Application No. 10-2003-0029912 filed in KOREA on May 12, 2003, the entire contents of which are hereby incorporated by reference.

BACKGROUND OF THE INVENTION

1. Field of the Invention

The present invention relates to a scroll compressor, and more particularly, to an apparatus for preventing overheat of a scroll compressor capable of protecting components by preventing temperature of compression gas from being excessively increased.

2. Description of the Conventional Art

Generally, a scroll compressor is an apparatus for compressing gas accordingly as an orbit scroll 60 performs an orbit movement by being coupled to a fixed scroll 50. The scroll compressor can be classified into various types according to an installation form and a method for sealing a compression space.

FIG. 1 shows one embodiment of the scroll compressor. As shown, the scroll compressor comprises a hermetic container 10 to which a gas suction pipe 1 and a gas discharge pipe 2 are respectively coupled; a main frame 20 and a sub frame 30 fixedly coupled to inner upper and lower portions of the hermetic container 10, respectively; a driving motor 40 fixedly coupled to inside of the hermetic container 10 so as to be located between the main frame 20 and the sub frame 30; a fixed scroll 50 fixedly coupled to inside of the hermetic container 10 with a certain gap from the main frame 20; an orbit scroll 60 coupled between the fixed scroll 50 and the main frame 20 to perform an orbit movement by being coupled to the fixed scroll 50; a crank axis 41 for transmitting a driving force of the driving motor 40 to the orbit scroll 60; an Oldham ring 70 inserted between the orbit scroll 60 and the main frame 20 for preventing a rotation of the orbit scroll 60; a high/low pressure separating plate 80 coupled to inside of the hermetic container 10 to be located between the gas discharge pipe 2 and the fixed scroll 50 for separating inside of the hermetic container 10 into a high pressure portion and a low pressure portion; and a backflow preventing means 90 installed at an upper portion of the fixed scroll 50 to be located in the high pressure portion for preventing gas of the high pressure portion from backwardly flowing to inside of the fixed scroll 50. Oil is filled at a lower portion of the hermetic container 10.

The fixed scroll 50 is provided with a wrap 52 of an involute shape formed at a lower portion of a body portion 51 having a predetermined shape, and a discharge hole 53 formed in the middle of the body portion 51. The orbit scroll 60 is provided with a wrap 62 of an involute shape formed at an upper surface of an end plate portion 61 having a predetermined area. A sealing S for sealing gas in an axial direction is respectively coupled to tips of the wrap 52 of the fixed scroll and the wrap 62 of the orbit scroll. The sealing S is formed of resin based material.

The driving motor 40 is composed of a stator 42 fixedly coupled to an inner circumferential surface of the hermetic container 10, a winding coil 43 wound on the stator 42, and a rotor 44 rotatably inserted into the stator 42. The crank axis 41 is pressed-inserted into the rotor 44.

The backflow preventing means 90 formed as a predetermined shape is composed of a valve housing 92 coupled to the fixed scroll 50 by a plurality of bolts 91, and a check valve 93 inserted into the valve housing 92 to be movable up and down for opening and closing the discharge hole 53 of the fixed scroll 50.

Operation of the scroll compressor will be explained.

First, the driving motor 40 is operated by an applied power source thus to generate a rotational force, and the rotational force of the driving motor 40 is transmitted to the orbit scroll 60 through the crank axis 41. The orbit scroll 60 is prevented from being rotated by the Oldham ring 70 and the crank axis 41, and performs an orbit movement by being coupled to the fixed scroll 50. By the orbit movement of the orbit scroll 60, the wrap 62 of the orbit scroll and the wrap 52 of the fixed scroll perform an orbit movement by being coupled to each other, thereby sucking gas, compressing, and discharging to the discharge hole 53 of the fixed scroll.

At this time, the check valve 93 of the backflow preventing means moves up and down by a pressure difference and its own weight, thereby opening and closing the discharge hole 53 of the fixed scroll. That is, when a pressure inside of a compression space (a pocket) formed by the fixed scroll 50 and the orbit scroll 60 is higher than a pressure of the high pressure portion, the check valve 93 opens the discharge hole 53, and when a pressure inside of the compression space is lower than a pressure of the high pressure portion, the check valve 93 blocks the discharge hole 53. Accordingly, high pressure gas is discharged to the high pressure portion, and gas of the high pressure portion is prevented from backwardly flowing into the fixed scroll 50 and the orbit scroll 60. If gas of the high pressure portion backwardly flows into the fixed scroll 50 and the orbit scroll 60, the orbit scroll 60 is reversely rotated thus to cause the wrap 62 of the orbit scroll to collide with the wrap 52 of the fixed scroll, thereby generating collision noise and damaging components.

Also, gas compressed in the compression space formed by the wrap 52 of the fixed scroll and the wrap 62 of the orbit scroll is prevented from being leaked by the sealing S of the fixed scroll 50 and the sealing S of the orbit scroll.

High pressure gas discharged to the discharge hole 53 of the fixed scroll passes through the high pressure portion thus to be discharged to the gas discharge pipe 2. The refrigerant gas of high temperature and high pressure is introduced into a condenser (not shown) constituting a refrigerating cycle.

The scroll compressor constitutes the refrigerating cycle system. Herein, when an amount of a refrigerant which circulates in the cycle becomes less than a preset amount, or when gas leakage is generated between the compression spaces formed by the wrap 52 of the fixed scroll and the wrap 62 of the orbit scroll at the time of driving, or when a difference between a suction pressure and a discharge pressure becomes greater than a preset condition, or in other cases, temperature of compression gas is increased. At this time, the compression gas is excessively overheated, other components such as the sealing S constituting a compression portion are damaged.

Accordingly, as a conventional method for preventing said component damage due to overheat of compression gas, as shown in FIG. 2, an overload preventing device 100 using a bimetal principle is mounted on the winding coil 43 constituting the driving motor 40. The overload preventing device 100 is a component generally used in a compressor.

In said structure, when temperature of compression gas is increased into high temperature at the time of driving, the high pressure portion to which discharge gas is introduced is heated and the heat is entirely transmitted as time lapses thus to be transmitted to the overload preventing device 100 mounted at the driving motor 40. When the heat is transmitted to the overload preventing device 100 and thereby the overload preventing device 100 is heated, a power source terminal is curved by the bimetal principle thus to cut off a power source and thereby current supplied to the driving motor 40 is cut off. Accordingly, the compression gas is prevented from being increased into high temperature thus to protect components.

Besides, the overload preventing device 100 is operated even while a power source more than a preset value is excessively applied to the driving motor 40, thereby cutting off a power source of the driving motor 40.

However, in said conventional structure, since the overload preventing device 100 which detects heat is installed at a part far from a compression portion for compressing gas with a certain distance, a temperature variation generated at the compression portion is not sensitively detected by the overload preventing device 100. According to this, when temperature of the compression gas is constantly increased, it doesn't matter by the overload preventing device 100, but when temperature of the compression gas is drastically increased, components such as the sealing S formed of resin based material are damaged due to a slow reaction of the overload preventing device 100.

SUMMARY OF THE INVENTION

Therefore, an object of the present invention is to provide an apparatus for preventing overheat of a scroll compressor capable of protecting components by preventing temperature of compression gas from being excessively increased.

To achieve these and other advantages and in accordance with the purpose of the present invention, as embodied and broadly described herein, there is provided an apparatus for preventing overheat of a scroll compressor comprising a hermetic container, a frame fixedly coupled to inside of the hermetic container, a driving motor provided with an overload preventing device for connecting or cutting off a power source by a temperature and a current and fixedly coupled to inside of the hermetic container, a fixed scroll provided with a discharge hole for discharging gas and coupled to the frame, an orbit scroll orbit-movably coupled to the fixed scroll, and a crank axis for transmitting a driving force of the driving motor to the orbit scroll, the apparatus comprising: a valve housing formed as a predetermined shape and fixedly coupled to the fixed scroll; a volume type valve movably inserted into the valve housing for opening and closing the discharge hole of the fixed scroll; and a valve pressurizing means located in the valve housing for increasing an input current by pushing the volume type valve and thus by blocking the discharge hole when temperature of discharge gas discharged to the discharge hole of the fixed scroll is more than a predetermined temperature.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
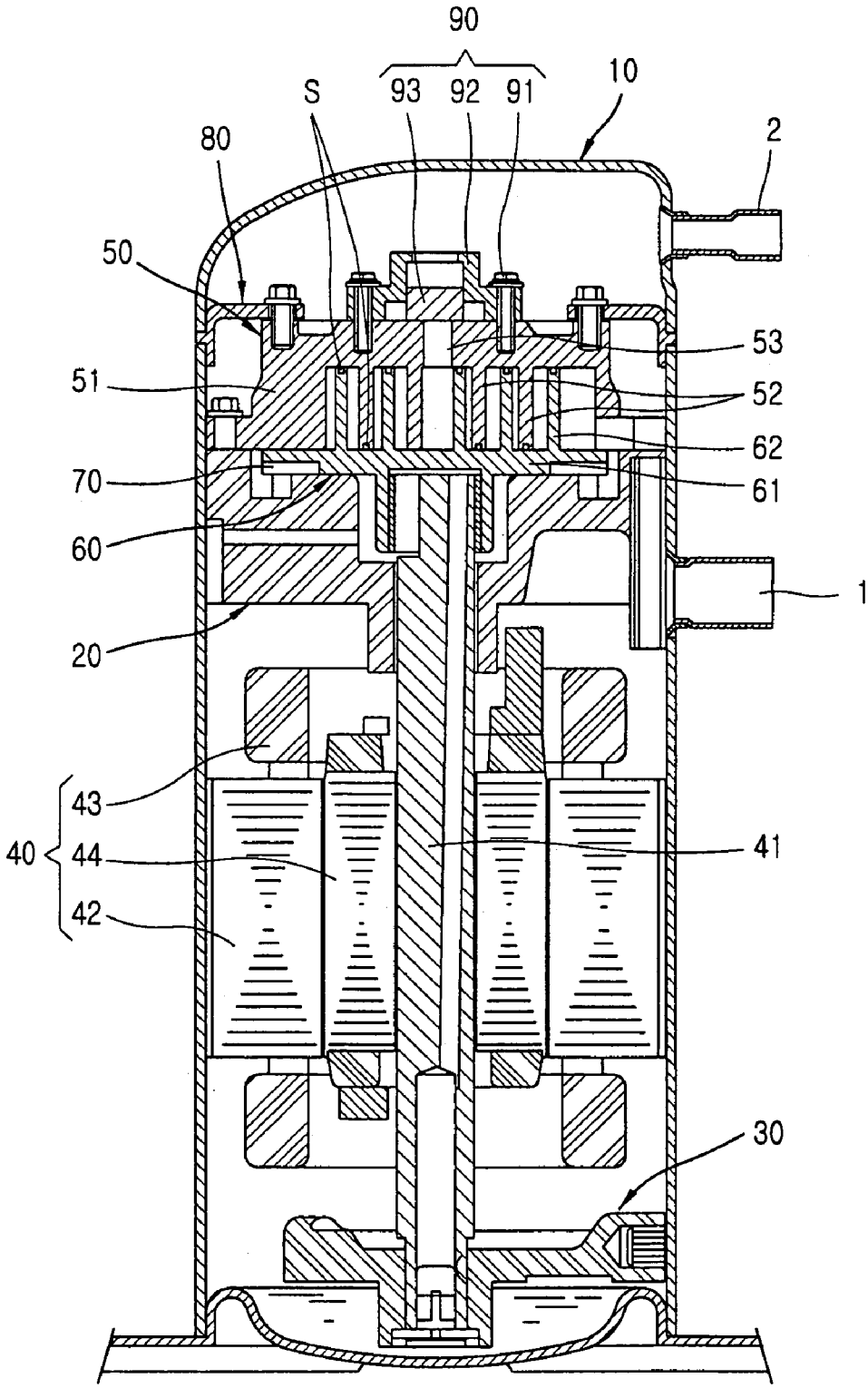
FIG. 1 CONVENTIONAL ART
FIG. 1 is a sectional view showing a general scroll compressor.
Figure 2:
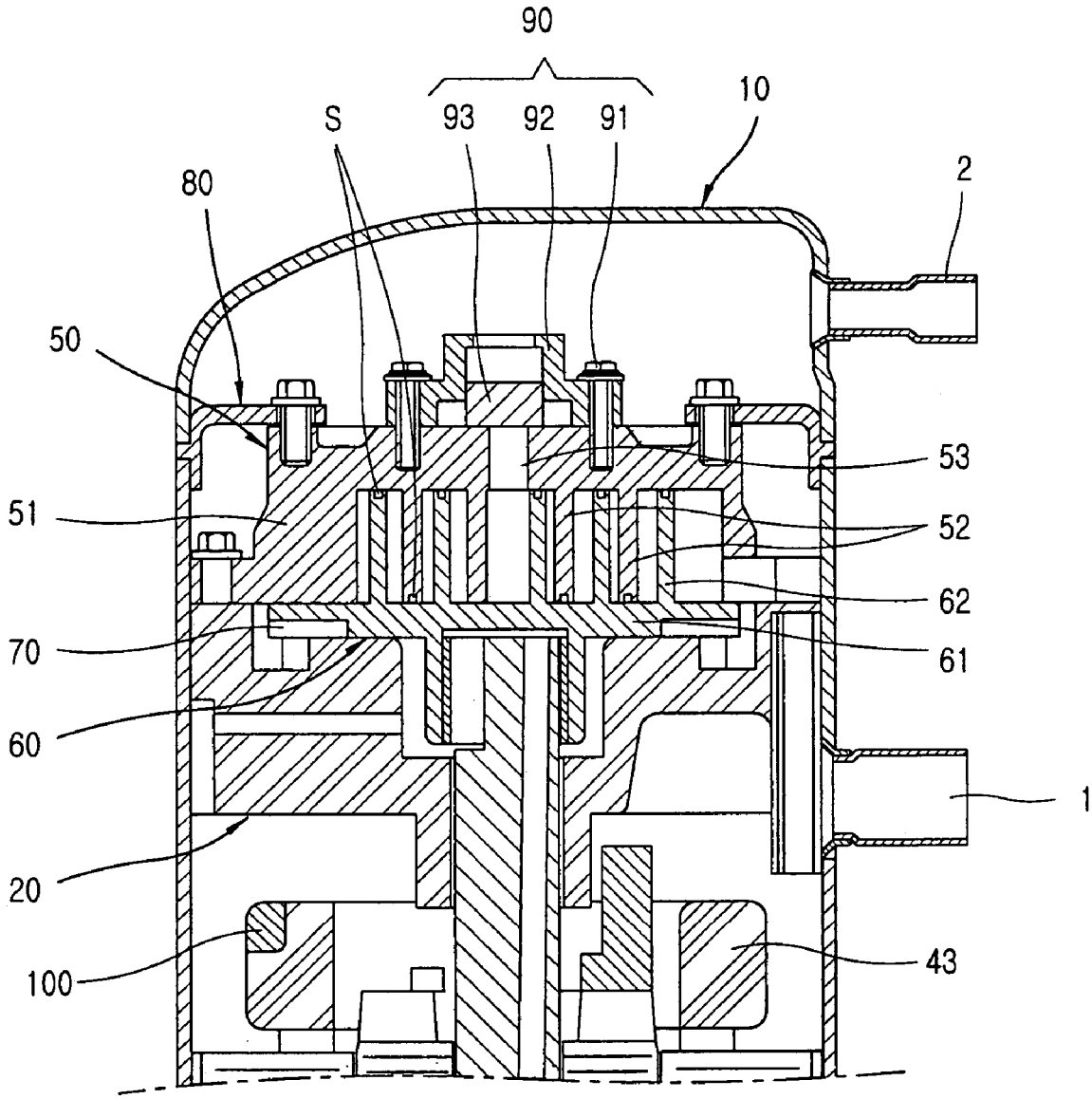
FIG. 2 CONVENTIONAL ART
FIG. 2 is a sectional view partially showing a scroll compressor provided with an overload preventing device in accordance with the conventional art.
Figure 3:
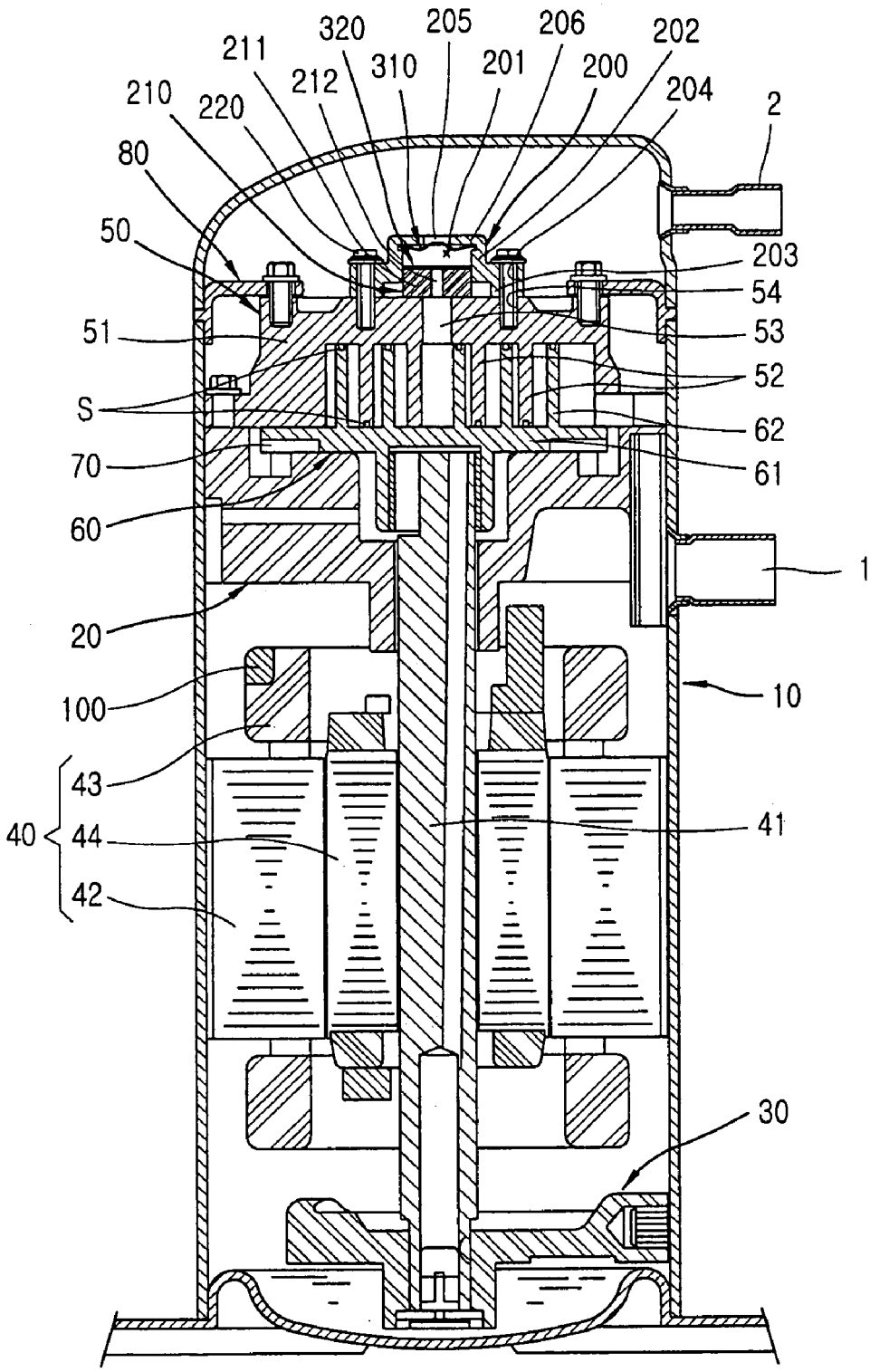
FIG. 3 is a sectional view showing a scroll compressor to which one embodiment of an apparatus for preventing overheat of a scroll compressor according to the present invention is applied.
Figure 4:
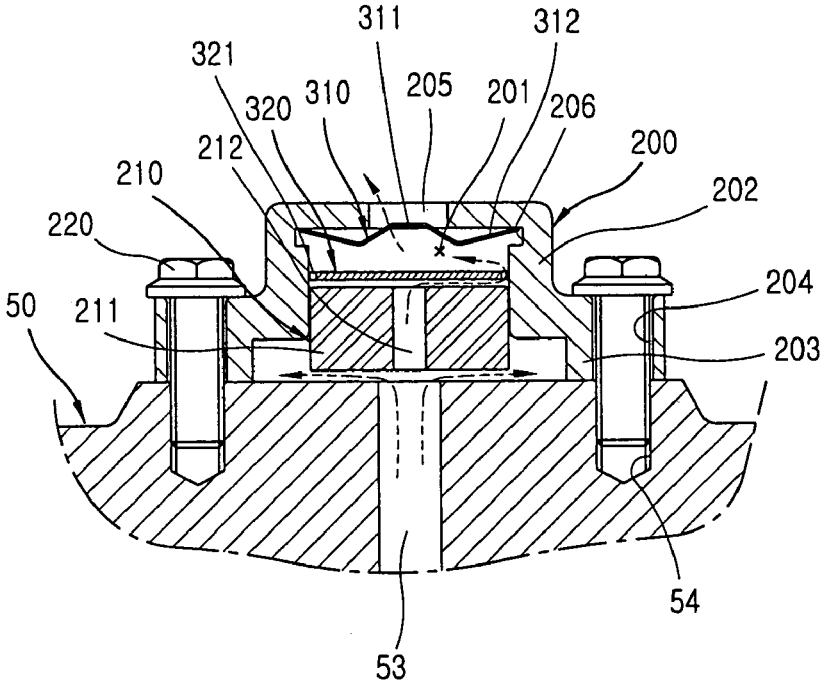
FIGS. 4 and 5 are sectional views respectively showing an operational state of the apparatus for preventing overheat of a scroll compressor according to the present invention.
Figure 5:
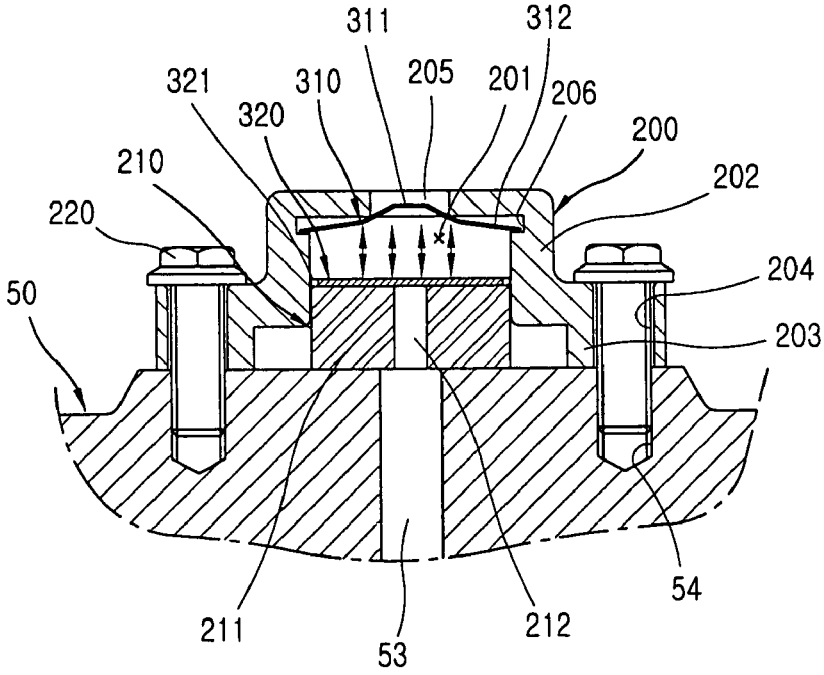

FIG. 3 is a sectional view showing a scroll compressor to which one embodiment of an apparatus for preventing overheat of a scroll compressor according to the present invention is applied, and FIGS. 4 and 5 are sectional views respectively showing an operational state of the apparatus for preventing overheat of a scroll compressor according to the present invention. The same reference numerals will be given to the same parts as the conventional one.

As shown, the scroll compressor comprises a hermetic container 10 to which a gas suction pipe 1 and a gas discharge pipe 2 are respectively coupled; a main frame 20 and a sub frame 30 fixedly coupled to inner upper and lower portions of the hermetic container 10, respectively; a driving motor 40 fixedly coupled to inside of the hermetic container 10 so as to be located between the main frame 20 and the sub frame 30; a fixed scroll 50 fixedly coupled to inside of the hermetic container 10 with a certain gap from the main frame 20; an orbit scroll 60 coupled between the fixed scroll 50 and the main frame 20 to perform an orbit movement by being coupled to the fixed scroll 50; a crank axis 41 for transmitting a driving force of the driving motor 40 to the orbit scroll 60; an Oldham ring 70 inserted between the orbit scroll 60 and the main frame 20 for preventing a rotation of the orbit scroll 60; and a high/low pressure separating plate 80 coupled to inside of the hermetic container 10 to be located between the gas discharge pipe 2 and the fixed scroll 50 for separating inside of the hermetic container 10 into a high pressure portion and a low pressure portion.

The fixed scroll 50 is provided with a wrap 52 of an involute shape formed at a lower portion of a body portion 51 having a predetermined shape, and a discharge hole 53 formed in the middle of the body portion 51. The orbit scroll 60 is provided with a wrap 62 of an involute shape formed at an upper surface of an end plate portion 61 having a predetermined area. A sealing S for sealing gas in an axial direction is respectively coupled to tips of the wrap 52 of the fixed scroll and the wrap 62 of the orbit scroll. The sealing S is formed of resin based material.

The driving motor 40 is composed of a stator 42 fixedly coupled to an inner circumferential surface of the hermetic container 10, a winding coil 43 wound on the stator 42, and a rotor 44 rotatably inserted into the stator 42. The crank axis 41 is pressed-inserted into the rotor 44. Also, an overload preventing device 100 is mounted on the winding coil 43. The overload preventing device 100 which is a component generally used in a compressor cuts off a power source supplied to the driving motor 40 by using a bimetal principle when a current more than a preset value flows or heat more than a preset value is transmitted.

Also, the apparatus for preventing overheat of the present invention is installed at an upper portion of the fixed scroll 50 to be located at the high pressure portion.

The apparatus for preventing overheat according to the present invention comprises: a valve housing 200 fixedly coupled to an upper surface of the fixed scroll 50; a volume type valve 210 movably inserted into the valve housing 200 for opening and closing the discharge hole 53 of the fixed scroll; and a valve pressurizing means located in the valve housing 200 for increasing an input current by pushing the volume type valve 210 and thus by blocking the discharge hole 53 when temperature of discharge gas discharged to the discharge hole 53 of the fixed scroll 50 is more than a predetermined temperature.

The valve housing 200 is provided with a plurality of fixed boss portions 203 extending in a lengthwise direction at an edge of a body portion 202 having a cap shape and provided with a cylindrical guide space 201 therein. A screw hole 204 is penetratingly formed at the fixed boss portions 203, and a hole 205 is formed at an upper surface of the body portion 202. The valve housing 200 is coupled to the fixed scroll 50 accordingly as a fixing bolt 220 is coupled to the screw hole 54 formed at the fixed scroll 50 and the screw hole 204 of the fixed boss portion in a state that the valve housing 200 is located at the upper surface of the fixed scroll 50. At this time, the valve housing 200 is coupled to the fixed scroll 50 so that the guide space 201 of the body portion and the discharge hole 53 of the fixed scroll 50 can be located on the same line.

The volume type valve 210 is provided with a piston type body 211 having a certain length and outer diameter, a hole 212 is penetratingly formed in the middle of the piston type body 211, and an inner diameter of the hole 212 is smaller than that of the discharge hole 53 of the fixed scroll 50. The volume type valve 210 is movably inserted into the guide space 201 of the valve housing.

The valve pressurizing means is composed of a thermal valve 310 coupled to inside of the valve housing 200 and deformed by a set temperature for opening and closing the hole 205 of the valve housing, and a plate valve 320 inserted into the valve housing 200 in which discharge gas flows for opening and closing the hole 212 of the volume type valve according to a movement of the thermal valve 310.

The thermal valve 310 is composed of a convex opening/closing portion 311 of a convex disc shape for opening and closing the hole 205 of the valve housing, and a plurality of supporting portions 312 curvedly extending at a lateral surface of the convex opening and closing portion 311 with a predetermined length and supported by the valve housing 200.

The thermal valve 310 is coupled to inside of the valve housing 200 accordingly as the supporting portions 312 are movably inserted into a stepping groove 206 formed at an inner circumferential wall of the guide space 201 of the valve housing 200. At this time, the hole 205 of the valve housing is an opened state by the convex opening and closing portion 311 of the thermal valve 310. If the thermal valve 310 is excessively heated over a preset temperature, the supporting portions 312 are curved and thereby the convex opening and closing portion 311 blocks the hole 205 of the valve housing.

The plate valve 320 is formed of a disc shape having a certain thickness and is provided with a plurality of opening grooves 321 through which discharge gas is discharged at an edge thereof. The plate valve 320 can be formed as various shapes. The plate valve 320 is movably inserted into the guide space 201 of the valve housing to be located at an upper surface of the volume type valve 210.

Operation of the apparatus for preventing overheat of a scroll compressor according to the present invention will be explained.

First, operation of the scroll compressor will be explained. When a power source is applied to the scroll compressor, the driving motor 40 is operated and thereby a rotational force is generated. The rotational force of the driving motor 40 is transmitted to the orbit scroll 60 through the crank axis 41. The orbit scroll 60 is prevented from being rotated by the Oldham ring 70 and the crank axis 41, and performs an orbit movement by being coupled to the fixed scroll 50. By the orbit movement of the orbit scroll 60, the wrap 62 of the orbit scroll and the wrap 52 of the fixed scroll perform an orbit movement by being coupled to each other, thereby continually sucking gas, compressing, and discharging to the discharge hole 53 of the fixed scroll.

At the same time, the volume type valve 210 and the plate valve 320 respectively move up and down by a pressure difference and its own weight, thereby opening and closing the discharge hole 53 of the fixed scroll 50. That is, when a pressure of discharge gas discharged after being compressed by the fixed scroll 50 and the orbit scroll 60 is higher than a pressure of the high pressure portion, the volume type valve 210 moves upwardly by being slid along an inner circumferential wall of the guide space 201 of the valve housing and thereby opens the discharge hole 53 of the fixed scroll. Accordingly, the compressed gas is discharged through the discharge hole 53. Most of the discharge gas discharged through the discharge hole 53 is introduced into the high pressure portion through intervals between the fixed boss portions 203 of the valve housing, and a part of the discharge gas pushes up the plate valve 320 by passing through the hole 212 of the volume type valve and is discharged to the high pressure portion through the thermal valve 310 and the hole 205 of the valve housing.

Herein, when the discharge gas is discharged by the fixed scroll 50 and the orbit scroll 60 in a state that a temperature thereof exceeds a preset temperature, a part of the heated discharge gas passes through the thermal valve 310 through the hole 212 of the valve and is discharged to the high pressure portion through the hole 205 of the valve housing. At this time, the heated discharge gas heats the thermal valve 310 and thereby the thermal valve 310 is deformed, thereby blocking the hole 205 of the valve housing. When the hole 205 of the valve housing is blocked by the thermal valve 310, discharge gas which flows through the hole 212 of the volume type valve is discharged by passing through the plate valve 320 and is filled in the guide space 201 between the thermal valve 310 and the plate valve 320. According to this, a pressure of the guide space 201 becomes high, and the volume type valve 210 and the plate valve 320 are pushed down by their own weights and gradually blocks the discharge hole 53 of the fixed scroll, that is, a flow channel of discharge gas, thereby increasing a discharge resistance of the discharge gas. Accordingly, an input current for driving the orbit scroll 60 is increased and thereby a power source is cut off by the overload preventing device 100, thereby stopping a driving of the driving motor 40. As the driving motor 40 is stopped, discharge gas is prevented from being overheated.

Meanwhile, when a pressure of the high pressure portion is greater than that of the discharge hole 53 of the fixed scroll, the plate valve 320 and the volume type valve 210 are pushed down thus to block the discharge hole 53, thereby preventing gas of the high pressure portion from backwardly flowing into the fixed scroll 50 and the orbit scroll 60. Gas compressed in the compression space formed by the wrap 52 of the fixed scroll and the wrap 62 of the orbit scroll is prevented from being leaked by the sealing S of the fixed scroll 50 and the sealing S of the orbit scroll 60.

Figure 6:
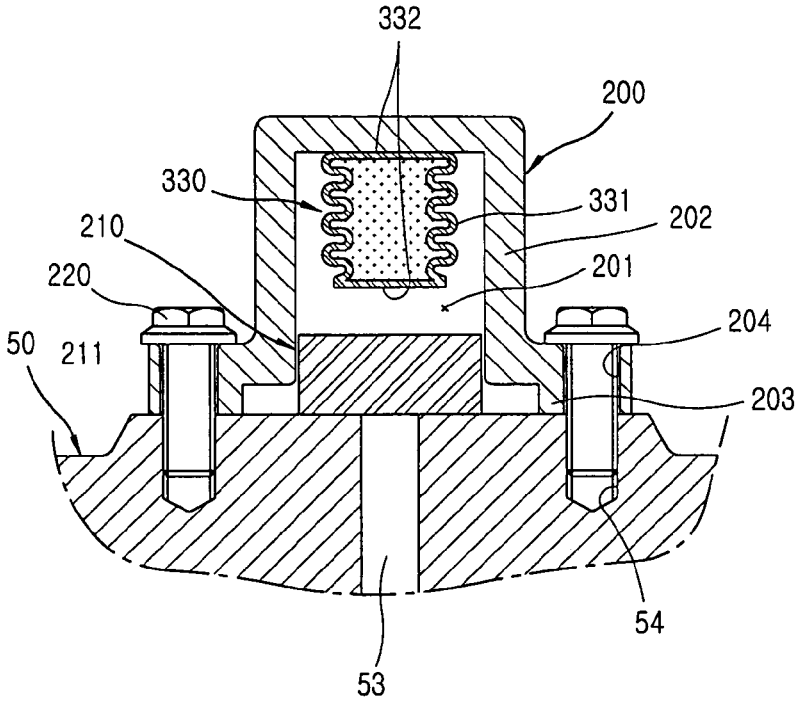
FIG. 6 is a sectional view showing another embodiment of the apparatus for preventing overheat of a scroll compressor according to the present invention.

FIG. 6 is a sectional view showing another embodiment of the apparatus for preventing overheat of the scroll compressor according to the present invention. The same reference numerals were given to the same components as those of FIG. 3.

As shown, the valve pressurizing means is coupled to inside of the valve housing 200 so that a bellows valve 330 of which inner filled gas can be expanded or contracted by heat can be located near the volume type valve 210.

The bellows valve 330 is composed of a bellows portion 331 formed as a cylindrical shape, lateral surface portions 332 formed at both sides of the bellows portion 331 for sealing inside of the bellows portion 331, and gas filled at an inner space formed by the bellow portion 331 and said both lateral surface portions 332. One lateral surface portion 332 of said two lateral surface portions 332 is fixedly coupled to an inner upper surface of the valve housing 200.

At this time, an outer diameter of the volume type valve 210 is smaller than an inner diameter of the guide space 201 so that an interval can be formed between an inner circumferential surface of the guide space 201 of the valve housing and an outer circumferential surface of the volume type valve 210 inserted into the guide space 201. Also, the hole 205 formed at an upper surface of the body portion 202 of the valve housing can be excluded.

Operation of the apparatus for preventing overheat of the scroll compressor is as follows.

Figure 7:
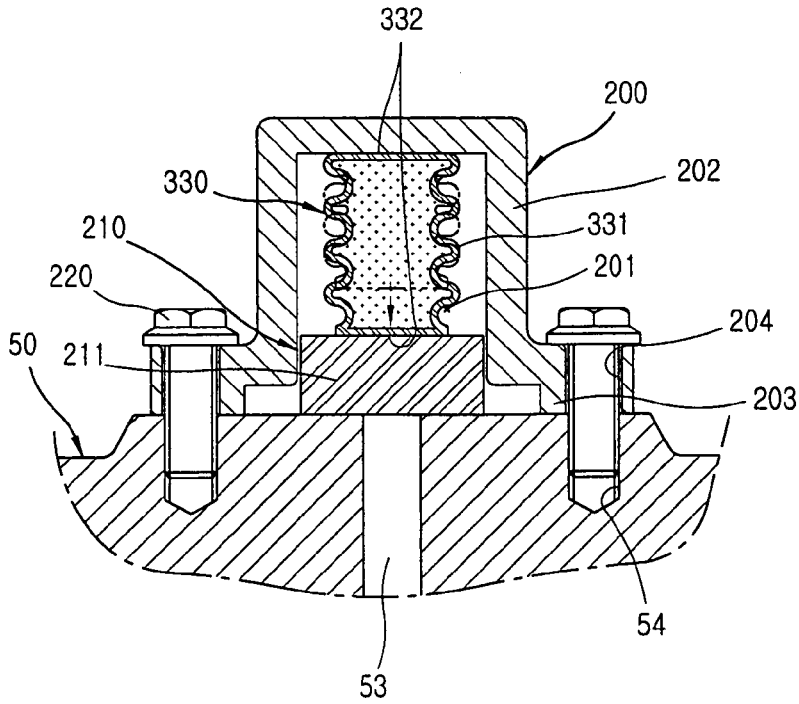
FIG. 7 is a sectional view showing an operational state of the apparatus for preventing overheat of a scroll compressor according to the present invention.
Figure 8:
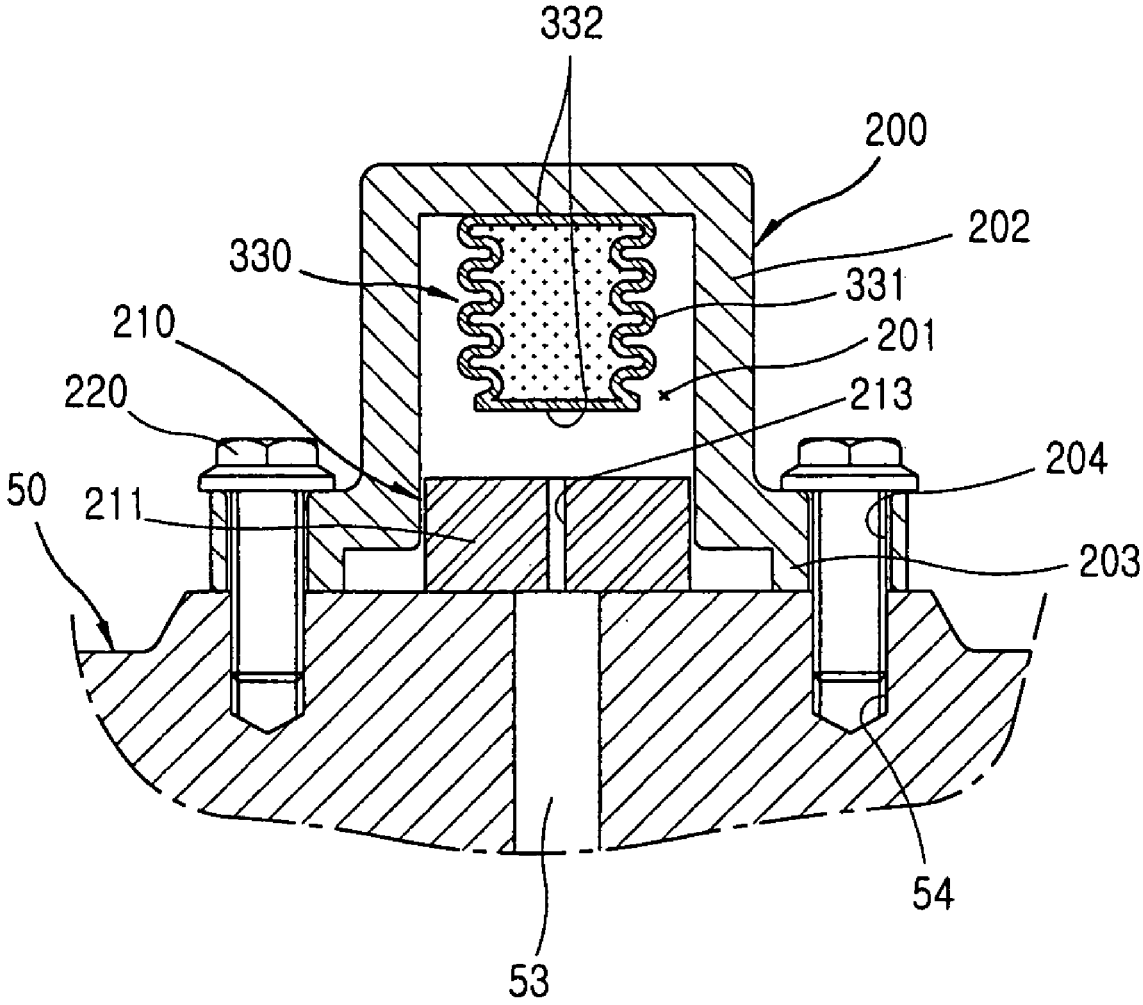
FIG. 8 is a sectional view showing another embodiment of the apparatus for preventing overheat of a scroll compressor according to the present invention.

When discharge gas is discharged by the fixed scroll 50 and the orbit scroll 60 in a state that a temperature thereof exceeds a preset temperature by several conditions while the scroll compressor is driven, a part of the heated discharge gas is introduced into the guide space and simultaneously heat is transmitted to inside of the guide space by the volume type valve 210, thereby heating the bellows valve 330 located at the guide space. As the bellow valve 330 is heated, as shown in FIG. 7, gas filled therein is expanded and the bellows valve 330 pushes the volume type valve 210. Accordingly, the volume type valve 210 gradually blocks the discharge hole 53 of the fixed scroll, that is, a flow channel of discharge gas thus to increase a discharge resistance of the discharge gas. According to this, an input current for driving the orbit scroll 60 is increased and thereby a power source is cut off by the overload preventing device 100, thereby stopping a driving of the driving motor 40 and thus preventing discharge gas from being overheated.

Meanwhile, a minute hole 213 having an inner diameter smaller than the discharge hole 53 can be formed at the volume type valve 210 inserted into the guide space 201 of the valve housing. Herein, heated discharge gas discharged to the discharge hole 53 is introduced into the guide space 201 through the minute hole 213 thus to heat the bellows valve 330, thereby heating and expanding the bellows valve 330 more fast.

As aforementioned, in the apparatus for preventing overheat of the scroll compressor according to the present invention, when a temperature of discharge gas is drastically or gradually increased and thus becomes a preset high temperature by several conditions at the time of driving the compressor, the driving of the overheated state is stopped by an immediate reaction. Accordingly, damage of components such as the sealing due to a continual driving in the overheated state can be prevented thus to enhance a reliability of the compressor.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for preventing overheat of a scroll compressor comprising a hermetic container, a frame fixedly coupled to inside of the hermetic container, a driving motor provided with an overload preventing device for connecting or cutting off a power source by a temperature and a current and fixedly coupled to inside of the hermetic container, a fixed scroll provided with a discharge hole for discharging gas and coupled to the frame, an orbit scroll orbit-movably coupled to the fixed scroll, and a crank axis for transmitting a driving force of the driving motor to the orbit scroll, the apparatus comprising:

a valve housing formed as a predetermined shape and fixedly coupled to the fixed scroll;

a volume type valve movably inserted into the valve housing for opening and closing the discharge hole of the fixed scroll; and a valve pressurizing means comprising a thermal valve located in the valve housing where discharge gas flows for closing a hole of the valve housing for increasing an input current by pushing the volume type valve and thus by blocking the discharge hole based on temperature of discharge gas discharged to the discharge hole of the fixed scroll being more than a predetermined temperature.

2. The apparatus of claim 1, wherein the valve pressurizing means is coupled to inside of the valve housing so that a bellows valve of which inner filled gas can be expanded or contracted by heat can be located near the volume type valve.

3. The apparatus of claim 2, wherein the bellows valve comprises:

a bellows portion formed as a cylindrical shape;

both lateral surface portions for sealing inside of the bellows portion; and gas filled at an inner space formed by the bellow portion and said both lateral surface portions, in which one lateral surface portion of said both lateral surface portions is fixedly coupled to the valve housing.

4. The apparatus of claim 2, wherein a penetration hole is formed in the middle of the volume type valve.

5. An apparatus for preventing overheat of a scroll compressor comprising a hermetic container, a frame fixedly coupled to inside of the hermetic container, a driving motor provided with an overload preventing device for connecting or cutting off a power source by a temperature and a current and fixedly coupled to inside of the hermetic container, a fixed scroll provided with a discharge hole for discharging gas and coupled to the frame, an orbit scroll orbit-movably coupled to the fixed scroll, and a crank axis for transmitting a driving force of the driving motor to the orbit scroll, the apparatus comprising:

a valve housing formed as a predetermined shape and fixedly coupled to the fixed scroll;

a volume type valve movably inserted into the valve housing for opening and closing the discharge hole of the fixed scroll; and a valve pressurizing means located in the valve housing for increasing an input current by pushing the volume type valve and thus by blocking the discharge hole based on temperature of discharge gas discharged to the discharge hole of the fixed scroll being more than a predetermined temperature, wherein the valve housing and the volume type valve are respectively provided with a hole, and the valve pressurizing means is composed of a thermal valve coupled to inside of the valve housing where discharge gas flows and deformed by a set temperature for opening and closing the hole of the valve housing, and a plate valve inserted into the valve housing where discharge gas flows for opening and closing the hole of the volume type valve according to a movement of the thermal valve.

6. The apparatus of claim 5, wherein the volume type valve is formed as a piston type bar shape having a certain length and outer diameter.

7. The apparatus of claim 5, wherein the thermal valve is composed of a convex opening/closing portion of a convex disc shape for opening and closing the hole of the valve housing, and a plurality of supporting portions curvedly extending from a lateral surface of the convex opening/closing portion with a predetermined length and supported by the valve housing.

* * * * *